United States Patent [19]

Craven et al.

[11] Patent Number: 4,878,062

[45] Date of Patent: Oct. 31, 1989

[54] GLOBAL POSITION SATELLITE ANTENNA

[75] Inventors: Tyson S. Craven, Boca Raton; Pushpa M. Choriyammakal, Plantation, both of Fla.

[73] Assignee: Dayton-Granger, Inc., Ft. Lauderdale, Fla.

[21] Appl. No.: 226,018

[22] Filed: Jul. 28, 1988

[51] Int. Cl.[4] ..... H01Q 1/42; H01Q 21/26

[52] U.S. Cl. ..... 343/872; 343/797

[58] Field of Search ..... 343/700 MS, 705, 793, 343/795, 797, 807, 826, 850, 872

[56] References Cited

U.S. PATENT DOCUMENTS

| | | | |
|---|---|---|---|
| 3,811,127 | 5/1974 | Griffee et al. | 343/705 |
| 4,414,550 | 11/1983 | Tiesselt | 343/700 MS |
| 4,431,998 | 2/1989 | Finken | 343/797 |
| 4,675,685 | 6/1987 | Finken | 343/708 |

*Primary Examiner*—Rolf Hille
*Assistant Examiner*—Doris J. Johnson
*Attorney, Agent, or Firm*—Biebel, French & Nauman

[57] ABSTRACT

A low profile, low drag, broad-banded antenna system includes four substantially identical antenna elements in intimate contact with a hemisphere of high dielectric constant material. The antenna elements are equally spaced from each other around the hemisphere and are connected to a power divider circuit for reception of incoming signals from a global position satellite having circular polarization. A dielectric phase equalizing member of variable thickness surrounds the antennas in intimate contact therewith for improving the axial ratio particularly at low angles of radiation. The dielectric phase equalizing member is also formed from a high dielectric constant material. A radome of a radio transparent material covers the assembly to provide an aerodynamic configuration and to protect the antenna from the weather. The antenna has a gain from approximately −2.5 dBic at 10° above the horizon to approximately +3 dBic at 30° above the horizon.

8 Claims, 3 Drawing Sheets

GLOBAL POSITION SATELLITE ANTENNA

BACKGROUND OF THE INVENTION

This invention relates to a low profile, low drag, broad-banded antenna system for receiving the circularly polarized signals from an orbiting global positioning satellite.

Orbiting satellites transmit coded signals which, when received and combined with signals from other satellites provide latitude and longitude information of the receiving station. These radio frequency signals are circularly polarized, and have low signal strengths. Any time any one of the satellites is near the horizon, the signal from that satellite is difficult to receive because prior art receiver antenna gain has been generally poor at low angles. Positioning information under those circumstances can be difficult if not impossible to obtain.

Antenna systems normally employed to receive these satellite signals, particularly for aircraft operations, must be capable of receiving the signals from the satellite at any position, either overhead or near the horizon. It is also important that the antenna, which is normally mounted on the upper outer surface of the aircraft, have a low profile design to minimize aerodynamic drag.

There have been several antennas developed to an attempt to receive positioning signals from orbiting satellites. These antennas generally include four antenna elements which are connected through a phase shifting network so that the circularly polarized signals are properly combined. These prior art satellite antennas, however, have not been successful in capturing the signals from the satellite when it is near the horizon.

SUMMARY OF THE INVENTION

In the present invention, four antenna elements are equally spaced around a solid hemisphere having a high dielectric constant. The outputs of the four antenna elements are connected to a phase shifting mechanism to provide a single electrical output to position indicating circuitry which analyzes the information contained in the signal to provide latitude and longitude information. The high dielectric constant hemisphere permits the antenna elements to be shortened substantially, and their reduced llength consequently reduces the size of the antenna structure that is exposed outside the aircraft. Further, a dielectric phase equalizing member, surrounding the hemisphere and in contact with the antenna elements near the base thereof, is provided to improve the axial ratio of the received signals at low angles of radiation, with respect to the base member, and therefore improves the performance of the antenna when the satellite is near the horizon.

In the preferred embodiment of the invention, the dielectric phase equalizing member and the hemisphere have a relative dielectric in the order of 3.8. Each antenna element has an arrow shaped configuration to broaden its bandwidth and thereby permit operation over a wide range of frequencies, preferably from 1.218 GHz to 1.585 GHz.

Accordingly, it is an object of this dimension to provide an improved antenna for receiving the global position satellite signals both overhead and at the horizon with an antenna that has a low profile and a low drag characteristic.

It is also an object of this invention to provide a global position satellite receiving antenna having circular polarization and high gain near the horizon and a low standing wave ratio comprising, a planar base member, four substantially identical antenna elements, phase splitting means connected to said antenna elements for combining the received signals at relative phases of 0, 90, 180 and 270 degress thereby effectively to receive signals having circular polarization, and a high strength radome for providing a cover for the antenna assembly, a hemisphere of high dielectric material mounted on said base member, said four substantially identical antenna elements mounted on and in contact with said hemisphere at substantially equal intervals, each of said elements having a base portion positioned near but insulated from said base member, and an apex portion positioned near the axis of said hemisphere, an dielectric phase equalizing member surrounding said hemisphere and in contact with said antenna elements near the base for improving the axial ratio at low angles of radiation with respect to said base member.

Other objects and advantages of the invention will be apparent from the following description, the accompanying drawings and the appended claims.

DESCRIPTION OF THE PREFERRED EMBODIMENT

Figure 1:
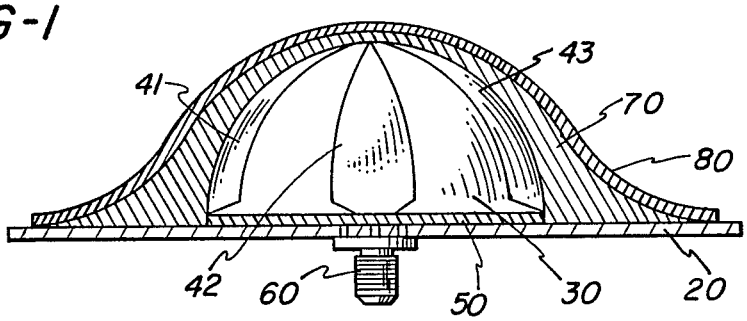
FIG. 1 is an elevational view , partly in cross-section, showing the components of the antenna structure without the protective radome.
Figure 2:
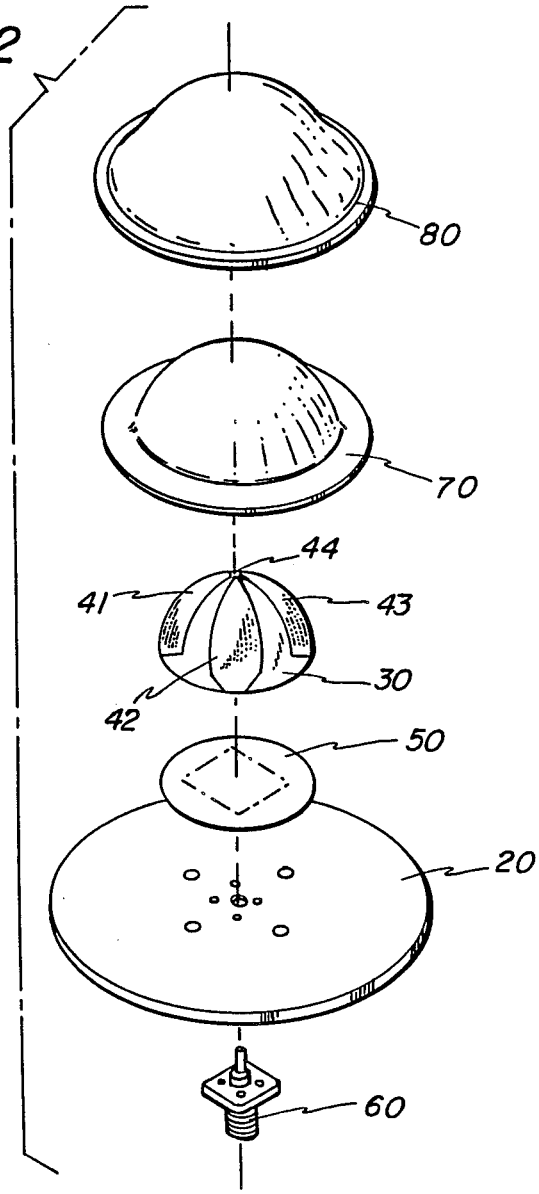
FIG. 2 is an exploded, perspective view, of the antenna system constructed according to this invention showing the basic components which comprise the antenna system.

Referring now to the drawings which illustrate a preferred embodiment of the invention, and particularly to FIGS. 1 and 2, the antenna system 10 of the present invention includes planar base member 20 that supports the antenna structure and mounts the antenna assembly to the upper surface of an aircraft, a hemisphere 30 on which four antenna elements 41–44 are supported, a phase shifting or power divider circuit 50 for combining the signals by the antenna elements in a common output connected to a coaxial fitting 60, and a dielectric phase equalizing member 70 which surrounds the lower portion of the antenna element to improve the axial ratio at low angles of radiation with respect to the base member. A radome 80 covering is included to protect the antenna system from the weather and from damage as the antenna moves with the aircraft through the atmosphere.

Figure 3:
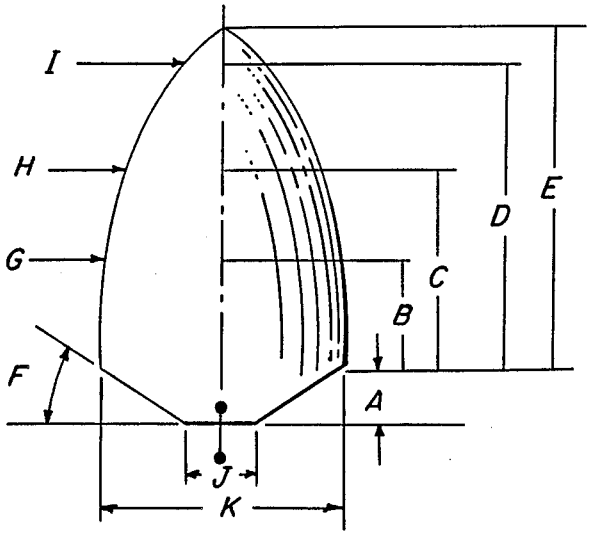
FIG. 3 is an elevational view of one of the antenna elements.

As shown in FIG. 3, each antenna element has a configuration similar to an arrowhead which gives it broad band characteristics, thus allowing the antenna to receive signals over a wide range of frequencies, and specifically from 1.218 GHz to 1.585 GHz, the range of frequencies needed to receive the position information from the orbiting satellites.

Each of the antenna elements 40 is preferably made of a high conductivity material, such as aluminum or preferably brass or copper foil. Each of the antenna elements had the following dimensions (in inches), with reference to the reference letters in FIG. 3:

| | |
|---|---|
| A = 0.21 | G = 0.75 |
| B = 0.41 | H = 0.42 |
| C = 0.88 | I = 0.20 |
| D = 1.32 | J = 0.26 |
| E = 1.64 | K = 0.98 |
| F = 33° | |

The hemisphere 30 is a solid member made from a dielectric constant epoxy, such as Bisphenol A/Epichlorohydrin an epoxy casting resin manufactured under the trademark Stycast 1495. This material has a relative dielectric constant of 3.8 and permits a reduction of size in the antenna elements by the square root thereof, or by a factor of approximately 2.2. The diameter of the hemisphere is one-half wavelength at the center frequency divided by the square root of the dielectric constant. For a center frequency of 1.400 GHz, and a dielectric constant of 3.8, the diameter of 2.164 inches. Without the dielectric hemishere, the diameter of the antenna structure would be 4.218 inches. This reduction in the size of the antenna elements itself improves the aerodynamic characteristics of the antenna system.

This invention further includes means for improving the performance of the antenna at low angles of radiation, namely an dielectric phase equalizing member 70 surrounding the lower portion of the antenna elements. The dielectric phase equalizing member is made from a high dielectric constant material such as Bisphenol A/Epichlorohydrin and has a thickness that varies from approximately 0.025 inch at the upper portion to approximately 0.625 inch at the base.

As shown in FIG. 1, the dielectric phase equalizing 70 is in intimate contact with the antenna elements. The use of the dielectric phase equalizing 70 removes the axial ratio at low angles of radiation by equalizing the phase of the incoming signals for both the horizontal and vertical components of the incoming signal, and permits the antenna to have an acceptable gain with the satellite as close as 10 degrees above the horizon or less.

The gain of the antenna varies from approximately −2.5 dBic at 10 degrees above the horizon to approximately +3 dBic at 30 degrees above the horizon. Prior art antennas, on the other hand, have a gain of approximately −4 dBic at 10 degrees. Thus, it is clear that the gain of the present invention is substantially improved over prior art devices, thus allowing for improved reception of the global positioning signals.

The base member 20 is made of aluminum, and it is intended to be mounted directly on the surface of the aircraft. The position of the coax connector 60 with respect to the center of the antenna system is not particularly critical, although in the embodiment shown, the coax fitting is shown as being offset from the center of the hemisphere.

The radome 80 is made of a radio transparent material, such as polybutadiene-glass/quartz or G-10 fiberglass.

Figure 4:
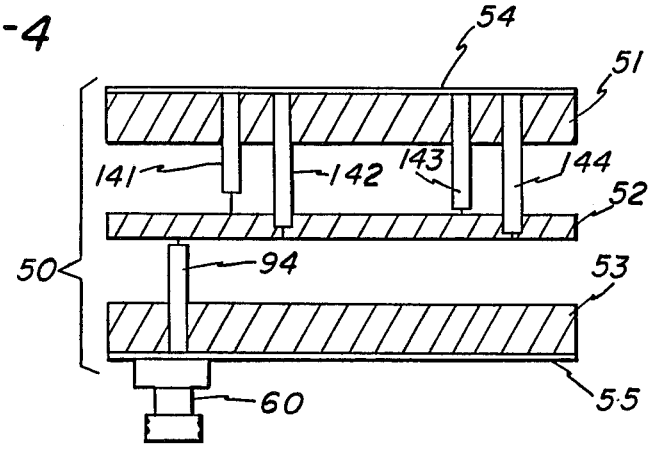
FIG. 4 is an exploded, cross-sectional elevational view of the power divider assembly.

Referring now to FIG. 4, the power divider circuit 50 is contained on three printed circuit boards 51–53. Each of these boards is made from a polytetrafluoroethylene and ceramic material which has a dielectric constant of 2.55.

The upper board 51 is adjacent the antenna and has a copper clad upper surface 54, except for a few openings through which the transmission lines to the antenna elements passes. The bottom board 53 is also copper clad on its outer or lower surface 55. A coaxial connector 60 is attached to the lower surface.

Figure 5:
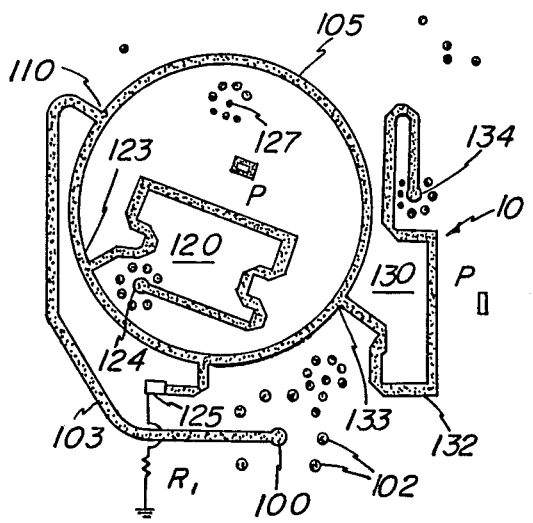
FIG. 5 is a plan view of one printed circuit board used in the power divider circuit.
Figure 6:
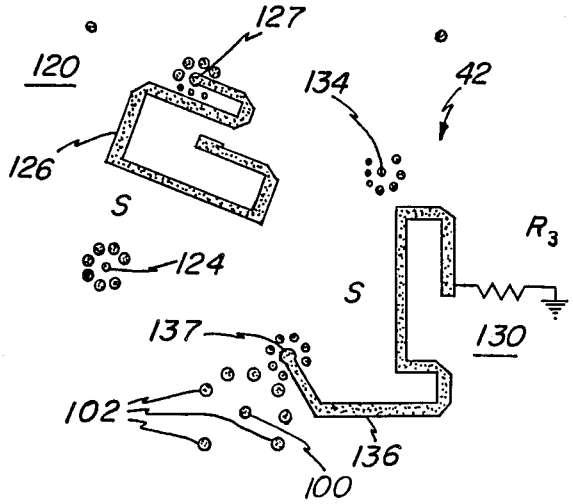
FIG. 6 is a plan view of another printed circuit board used in the power divider circuit.

The center board has a first printed circuit 90 etched on it upper surface as shown in FIG. 5, when viewed from the antenna side. A printed circuit 92 is also formed on the lower surface, as shown in FIG. 6, also as viewed from the antenna side. The two printed circuits 90 and 92, in combination, provide a power divider circuit that properly combines the energy received from the four antenna elements 41–44.

In FIG. 4, the three boards 52–53 comprising the power divider circuit are shown separated, but it is to be understood that these boards will be placed adjacent to one another, with no spaces therebetween, when the device is assembled for operation.

The center conductor of the coaxial connector 60 is connected to the printed circuit board 90 through a coax cable 94 which is fed through an opening in the lower board 53. The shield of the cable is connected to the copper plating 55 on the lower board 53 while the interior connector passes through the center board to the output feed point 100 (FIG. 5). Surrounding the output feed point 100 are a plurality of plated openings 102 which extend completely through the center board 52. These plated openings form a screen that acts to prevent radio frequency signals from extending beyond the limits defined by that screen.

The feed point 100 is connected by a line 102 to a circular trace 105 on the printed circuit board, commonly referred to as a rat race. The rat race 105 shown in FIG. 5 is six-quarters wave length in circumference at the operating frequency of the power divider circuit, and for purposes of this description, the connection of its line 102 with the rat race 105 at point 110 is defined as the 0 degree or reference position. Moving counterclockwise from point 110 to the first quarter-wave length position is a first power divider element 120, which will be described later. At the half-wave position, a connection is made to ground through a terminating resister 125, or in other words, to one of the copper clad plates. At the three-quarter-wave position, a second power divider 130 is connected to the rat race.

Each of the power divider circuits 120 and 130 works in an identical fashion, and their purpose is to combine the radio frequency energy received by each antenna element in equal amounts and apply that energy to the rat race at the proper phase angle.

The power divider circuit 120 shown in FIG. 5 is connected to antenna elements 41 and 42, which are at the 90 and 180 degree position on the antenna structure. Similarly, power divider 130 is connected to antenna elements 43 and 44, which are at the 270 and 360 degree positions.

Power divider 120 includes two components. The first component 122 is shown in FIG. 5 and is connected to the rat race at 123 and also to antenna element 41 through terminal 124 and coaxial cable 141 which extends upwardly through the upper or first board 51. The second component 126 is shown in FIG. 6 and is connected to antenna element 42 at terminal 127 through coaxial cable 142 and through a terminating resistor R2 to ground. Power divider circuit 130 also has two components, the first component 132 on the upper board (FIG. 5) is connected to the rat race at 133 and to the antenna element 43 through terminal 134 which is connected to coaxial cable 143. The second component 132 (FIG. 6) has one end connected to ground through terminating resistor R3 while the other end is connected to antenna element 44 through coaxial cable 144, the center conductor of which is connected to terminal 137.

Surrounding terminals 124, 127, 134 and 137 are a set of through plated holes 150 which act as a shield to prevent RF leakage at this point, similar to the shield 102 described above.

In the power divider circuit 120, the first component 122 is electrically associated with the second component 126 by means of corresponding quarter-wave sections P and S, which act as the two components of a radio frequency transformer. These two sections are placed directly opposite each other on either side of the middle board 52. Similarly, the two components 132 and 136 of the power divider circuit 130 includes corresponding quarter-wave sections P and S.

The width and separation of the quarter-wave sections P and S are designed to insure that each antenna contributes equally to the output of the power divider as the RF energy is applied to the rat race.

The power divider circuit, while of substantially conventional design, is made as small as possible to contribute to the overall configuration of the antenna system. The use of dielectric material for the boards contributes to the reduction in size of the power divider circuit. While a higher dielectric constant could be used further to reduce the size of the printed circuit elements, that may be undesirable if there are gaps appear and which would create larger discrepancies between the higher dielectric constant of the board and the much lower dielectric constant of air in the gap.

While the form of apparatus herein described constitutes a preferred embodiment of this invention, it is to be understood that the invention is not limited to this precise form of apparatus and that changes may be made therein without departing from the scope of the invention , which is defined in the appended claims.

What is claimed is:

1. A global position satellite receiving antenna having circular polarization and high gain near the horizon and a low standing wave ratio comprising, a planar base member, a hemisphere of high dielectric constant material placed on said base member, four substantially identical antenna elements in contact with said hemisphere at substantially equal intervals, each of said elements having a base portion positioned near but insulated from said base member, and an apex portion positioned near the axis of said hemisphere, power divider circuit means connected to said antenna elements for combining the received signals, and means for improving the axial ratio of the received signals at low angles of radiation with respect to the plane of said base member.

2. The receiving antenna of claim 1 wherein said means for improving the axial ratio of the received signals at low angles of radiation includes an dielectric phase equalizing member surrounding said hemisphere and in contact with said antenna elements near said base member

3. In a global position satellite receiving antenna having circular polarization and high gain near the horizon and a low standing wave ratio comprising, a planar base member, four substantially identical antenna elements, power divider circuit means connected to said antenna elements for combining the received signals at relative phases of 0, 90, 180 and 270 degree thereby effectively to receive signals having circular polarization, and a high strength radome for providing a cover for the antenna assembly, the improvement comprising a hemisphere of high dielectric material mounted on said base member, said four substantially identical antenna elements mounted on and in contact with said hemisphere at substantially equal intervals, each of said elements having a base portion positioned near but insulated from said base member, and an apex position positioned near the axis of said hemisphere.

an dielectric phase equalizing member surrounding said hemisphere and in contact with said antenna elements near the base for improving the axial ratio at low angles of radiation with respect to said base member.

4. The antenna of claim 1 wherein said ring member has a relative dielectric constant in the order of 3.8.

5. The antenna of claim 1 wherein said dielectric phase equalizing member is most effective in equalizing the phase of the incoming signals in the lower $\frac{2}{3}$ of the height of said hemisphere.

6. The antenna of claim 1 wherein said hemisphere has a relative dielectric constant in the order of 3.8.

7. The antenna of claim 1 wherein each of said antenna elements is electrically one-quarter wavelength long when mounted on said hemisphere.

8. The antenna of claim 1 including means for configuring each of said antenna elements to broaden the bandwidth of the antenna to permit operations from 1.217 gHz to 1.575 gHz.

* * * * *